US010738472B1

(12) United States Patent
Noonan et al.

(10) Patent No.: US 10,738,472 B1
(45) Date of Patent: Aug. 11, 2020

(54) INSERT FOR GUTTER AND DOWNSPOUT

(71) Applicants: Steven B. Noonan, Rocklin, CA (US); Curtis R. Richardson, Fort Collins, CO (US); Matthew M. Glanzer, Fort Collins, CO (US)

(72) Inventors: Steven B. Noonan, Rocklin, CA (US); Curtis R. Richardson, Fort Collins, CO (US); Matthew M. Glanzer, Fort Collins, CO (US)

(73) Assignee: Steven B. Noonan, Rocklin, CA (US)

( * ) Notice: Subject to any disclaimer, the term of this patent is extended or adjusted under 35 U.S.C. 154(b) by 0 days.

(21) Appl. No.: 16/679,453

(22) Filed: Nov. 11, 2019

Related U.S. Application Data

(60) Provisional application No. 62/820,468, filed on Mar. 19, 2019.

(51) Int. Cl.
*E04D 13/076* (2006.01)
*E04D 13/04* (2006.01)

(52) U.S. Cl.
CPC ..... *E04D 13/0767* (2013.01); *E04D 13/0409* (2013.01); *E04D 2013/0413* (2013.01)

(58) Field of Classification Search
CPC ..... E04D 13/0767; E04D 13/0409; E04D 2013/0413; E04D 13/076; E04D 2013/086
See application file for complete search history.

(56) References Cited

U.S. PATENT DOCUMENTS 316,578 A * 4/1885 Schumann ..... E04D 13/0767 210/162
2,446,256 A * 8/1948 Young ..... E04D 13/08 210/445
2,533,402 A * 12/1950 Schmitz, Jr. ..... E04D 13/0767 210/463
4,216,790 A * 8/1980 Stoltz ..... E03F 1/00 137/357
4,285,812 A * 8/1981 Stoltz ..... E03F 5/0404 210/162
5,409,602 A 4/1995 Sorenson
5,452,546 A * 9/1995 Goddard ..... E04D 13/08 210/170.03
5,535,554 A 7/1996 Harris, Jr.
5,536,406 A * 7/1996 Silva ..... B01D 29/33 210/460
5,634,299 A * 6/1997 Gaston ..... E04D 13/076 210/163
RE36,343 E * 10/1999 Silva ..... B01D 29/33 210/460

(Continued)

*Primary Examiner* — Rodney Mintz

(57) ABSTRACT

An insert for a rain gutter includes a first portion and a second portion. The first portion is configured to be positioned in the rain gutter and includes a plurality of apertures to allow water to flow from the rain gutter into an interior of the first portion when the first insert is positioned in the rain gutter. The second portion extends downward from the first portion and is positioned in an opening of the rain gutter connected to the downspout. The second portion includes a plurality of extensions separated by one or more slots. The second portion also includes a flange configured to be positioned above the opening of the rain gutter and an interior in fluid communication with the interior of the first portion. The interior of the second portion is configured to allow the water to flow through it and into the downspout.

18 Claims, 12 Drawing Sheets

(56) References Cited

U.S. PATENT DOCUMENTS

| | | | | |
|---|---|---|---|---|
| 6,035,580 | A * | 3/2000 | Carter | E04D 13/076 210/463 |
| 6,293,054 | B1 | 9/2001 | Cangialosi | |
| 7,051,480 | B1 * | 5/2006 | Dennis | E04D 13/0762 52/11 |
| 7,544,288 | B1 | 6/2009 | Cook | |
| 8,646,217 | B2 * | 2/2014 | Ratajac | E04D 13/0725 52/11 |
| 8,656,647 | B2 * | 2/2014 | Bath | E04D 13/076 52/11 |
| 9,003,714 | B2 * | 4/2015 | Vance | E04D 13/076 210/510.1 |
| 10,605,395 | B1 * | 3/2020 | Green | F16L 55/11 |
| 2006/0191208 | A1 | 8/2006 | MacIntyre | |
| 2006/0278573 | A1 | 12/2006 | Robinson | |
| 2010/0192479 | A1 * | 8/2010 | Elliott | E04D 13/106 52/24 |
| 2011/0283631 | A1 | 11/2011 | Bath et al. | |
| 2013/0283707 | A1 * | 10/2013 | Ratajac | E04D 13/076 52/12 |

* cited by examiner

INSERT FOR GUTTER AND DOWNSPOUT

CROSS REFERENCE TO RELATED APPLICATIONS

The present application claims priority to U.S. Provisional Patent Application No. 62/820,468, filed Mar. 19, 2019, which is hereby incorporated by reference in its entirety.

BACKGROUND

Rain gutter systems are commonly used on buildings to collect rainwater falling on a roof of the building and to transport it away from particular areas around the building and/or from the building's foundation. Typical rain gutter systems include rain gutters, sometimes referred to simply as "gutters," installed at or slightly below the edge of a roof. The gutter's channels collect water from the roof, allowing it to flow to a downspout pipe where it is brought to ground level and transported away from the foundation of the building or to a preferred location.

The transition point from the gutter to the downspout is prone to collect debris, such as leaves and twigs. This debris can restrict or prevent the flow of rainwater from the gutter channel into the downspout, resulting in a blockage and an accumulation of water in the gutter.

The accumulation of water in the gutter is undesirable for a number of reasons. In some situations, the accumulated water may serve as a breeding ground for mosquitos or other pests. In some situations, the weight of the accumulated water may damage the gutter channel or the roof itself. In some situations, the accumulated water may reach the roof, causing leakage or damage. In some situations, the accumulated water level may freeze, resulting in damage to the roof, gutter channel, and/or downspout.

Improvements in the foregoing are desired.

SUMMARY

In one exemplary embodiment, an insert for a rain gutter and a downspout is provided. The insert includes a first portion configured to be positioned in the gutter and a second portion extending downwardly from the first portion and configured to be positioned in an opening of the gutter connected to the downspout. The first portion includes a plurality of apertures distributed around a surface of the first portion. The apertures are configured to allow water to flow from the gutter into an interior of the first portion. The second portion includes a plurality of extensions separated by one or more slots. The plurality of extensions are configured to be positioned into the opening and a flange configured to be positioned above the opening. The second portion includes an interior in fluid communication with the interior of the first portion. The interior of the second portion is configured to allow water to flow from the interior of the first portion through the interior of the second portion and into the downspout.

In one exemplary embodiment, an insert for a rain gutter includes a first portion and a second portion. The first portion is configured to be positioned in the rain gutter. The first portion includes a plurality of apertures extending between an exterior of the first portion and an interior of the first portion. The apertures are configured to allow water to flow from the rain gutter into an interior of the first portion when the first insert is positioned in the rain gutter. The second portion extends downward from the first portion and is configured to be positioned in an opening of the rain gutter connected to the downspout. The second portion includes a plurality of extensions separated by one or more slots. The plurality of extensions are configured to be positioned in the opening connected to the downspout. The second portion further includes a flange configured to be positioned above the opening of the rain gutter. The second portion includes an interior in fluid communication with the interior of the first portion. The interior of the second portion is configured to allow the water to flow from the interior of the first portion through the interior of the second portion and into the downspout.

In one exemplary embodiment, a kit for a gutter and a downspout is provided. The kit includes as insert. The insert includes a first portion configured to be positioned in the gutter and a second portion extending downwardly from the first portion and configured to be positioned in an opening of the gutter connected to the downspout. The first portion includes a plurality of apertures configured to allow water to flow from the gutter into an interior of the first portion. The second portion includes a plurality of extensions separated by one or more slots. The plurality of extensions are configured to be positioned in the opening and a flange configured to be positioned above the opening. The second portion includes an interior in fluid communication with the interior of the first portion. The interior of the second portion is configured to allow water to flow from the interior of the first portion through the interior of the second portion and into the downspout. The kit may also include an adapter plate having an aperture. The plurality of extensions of the second portion of the insert are configured to be positioned through the aperture.

In one exemplary embodiment, a method of protecting a downspout from debris, is provided. The method includes positioning a first portion of an insert having a plurality of apertures into a gutter attached to the downspout and a second portion of an insert into an opening connecting the gutter down the downspout. The second portion extends downwardly from the first portion and including a plurality of extensions separated by one or more slots and a flange. The plurality of extensions are configured to be positioned in the opening and the flange configured to be positioned above the opening. The insert includes an interior configured to allow water to flow through one or more the plurality of apertures into the interior and through the interior of the insert into the downspout. Because the apertures are larger in number and distributed across a larger area, the chances of the apparatus becoming clogged are significantly less as compared to the gutter and downspout alone.

DETAILED DESCRIPTION

Figure 1:
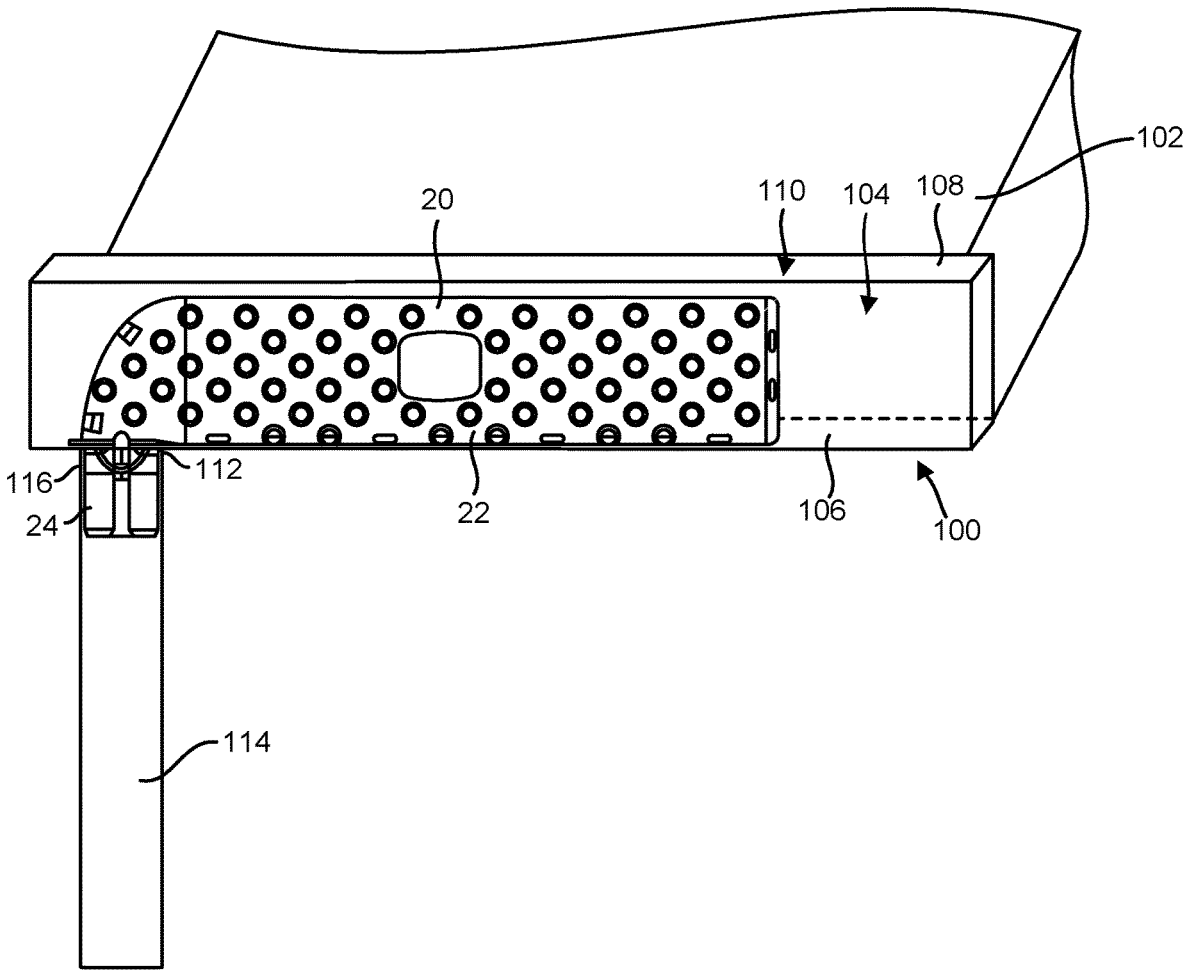
FIG. 1 illustrates an exemplary insert positioned in a gutter and downspout.

FIG. 1 illustrates an exemplary gutter 100 attached to the roof 102 of a building. Gutter 100 includes a channel 104 defined by a bottom 106, one or more walls 108 extending upwardly from bottom 106, and an open top 110. Although FIG. 1 illustrates channel 104 as substantially rectangular in shape, any suitable shape may be used, including any of styles A-L of the Sheet Metal and Air Conditioning Contractors National Association (SMACNA), fascia gutters, and half-round gutters.

Channel 104 illustratively includes opening 112 connecting channel 104 of gutter 100 to downspout 114. Downspout 114 extends away from gutter 100 to transport water collected in channel 104 downward, away from the building, and/or to a preferred location. Downspout 114 may be may be any suitable geometry, including geometries having substantially rectangular, square, or circular cross-sections. Because all of the water in this section of the gutter system flows through opening 112, without the benefit of the apparatus disclosed herein, opening 112 tends to be the location where leaves, stick, or debris may get caught and begin to form a clog. This occurs, at least in part, because there is only a single opening 112 that all of the water and debris tries to flow through as well as because some of the debris may be relatively large as compared to opening 112 and may not easily, readily, or reliably flow into opening 112.

In some embodiments, downspout 114 is attached directly to opening 112 of gutter 100. In other embodiments, gutter 100 includes an end drop 116 at least partially encircling opening 112 and extending downwardly from bottom 106 of gutter 100. In some embodiments, one or more screws or rivets are used to secure downspout 114 to gutter 100, such as through end drop 116.

Insert 20 is illustratively positioned into gutter 100 through open top 110. A first portion 22 of insert 20 is positioned primarily within channel 104 and may rest against the bottom 106 and one or more walls 108 of gutter 100. A second portion 24 of insert 20 is inserted into opening 112 of gutter 100. At least a portion of second portion 24 extends downwardly into downspout 114 and/or end drop 116. Insert 20 allows water to flow from gutter 100 into apertures 26 formed in first portion 22, through an interior (see FIG. 9) of insert 20, and from second portion 24 into downspout 114 and/or end drop 116.

Figure 2:
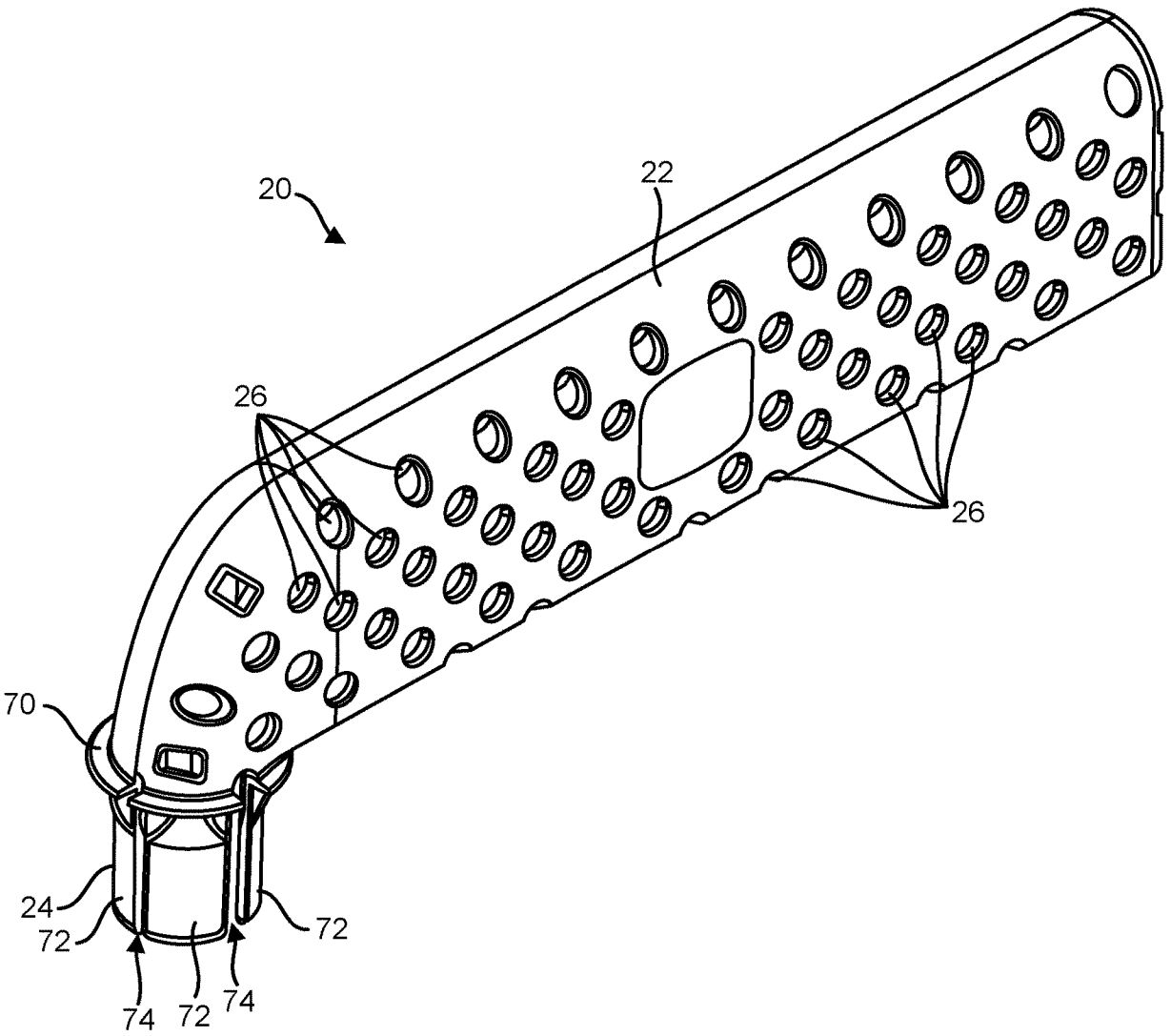
FIG. 2 illustrates an elevated perspective view of the insert of FIG. 1.
Figure 3:
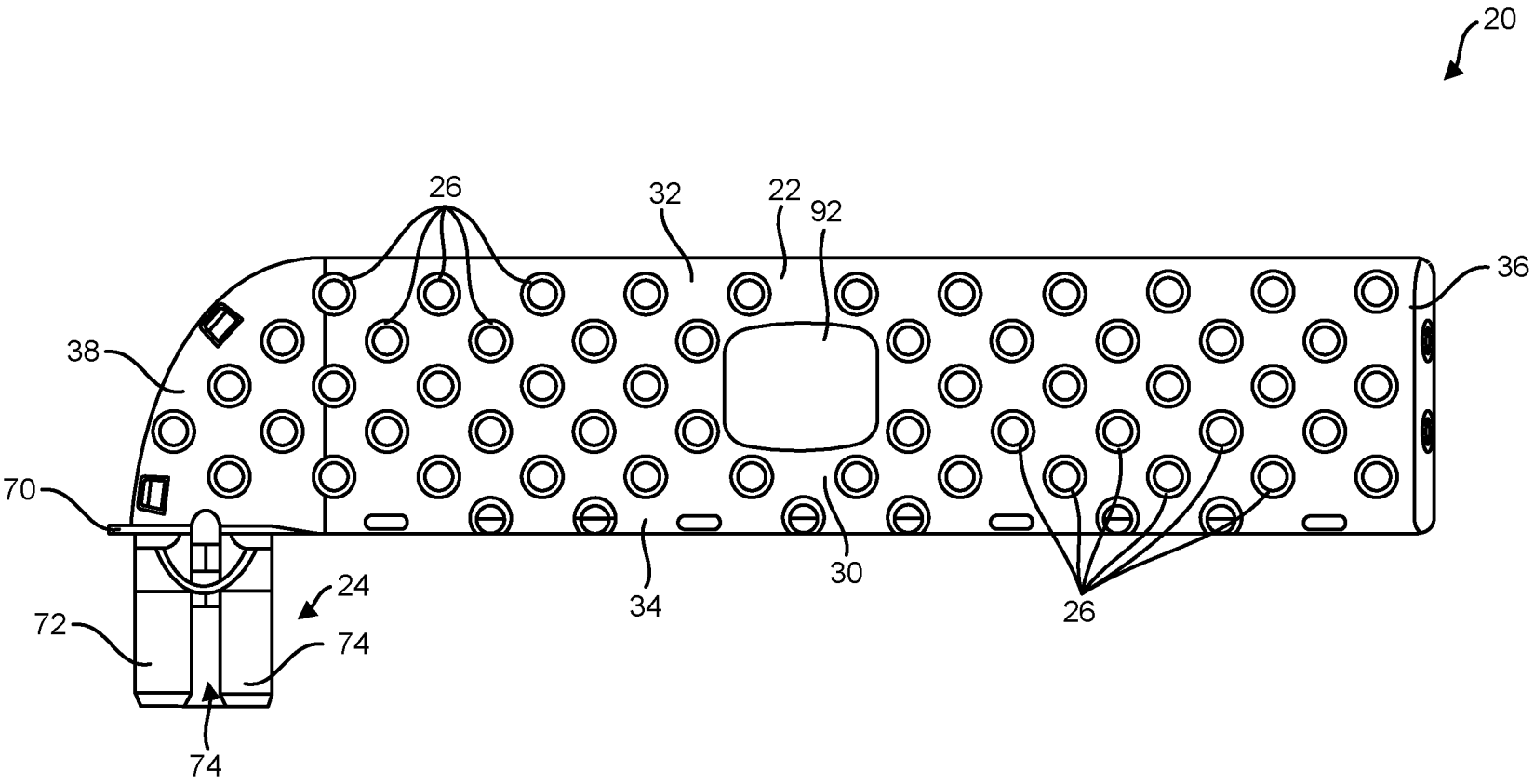
FIG. 3 illustrates a front view of the insert of FIG. 1.
Figure 4:
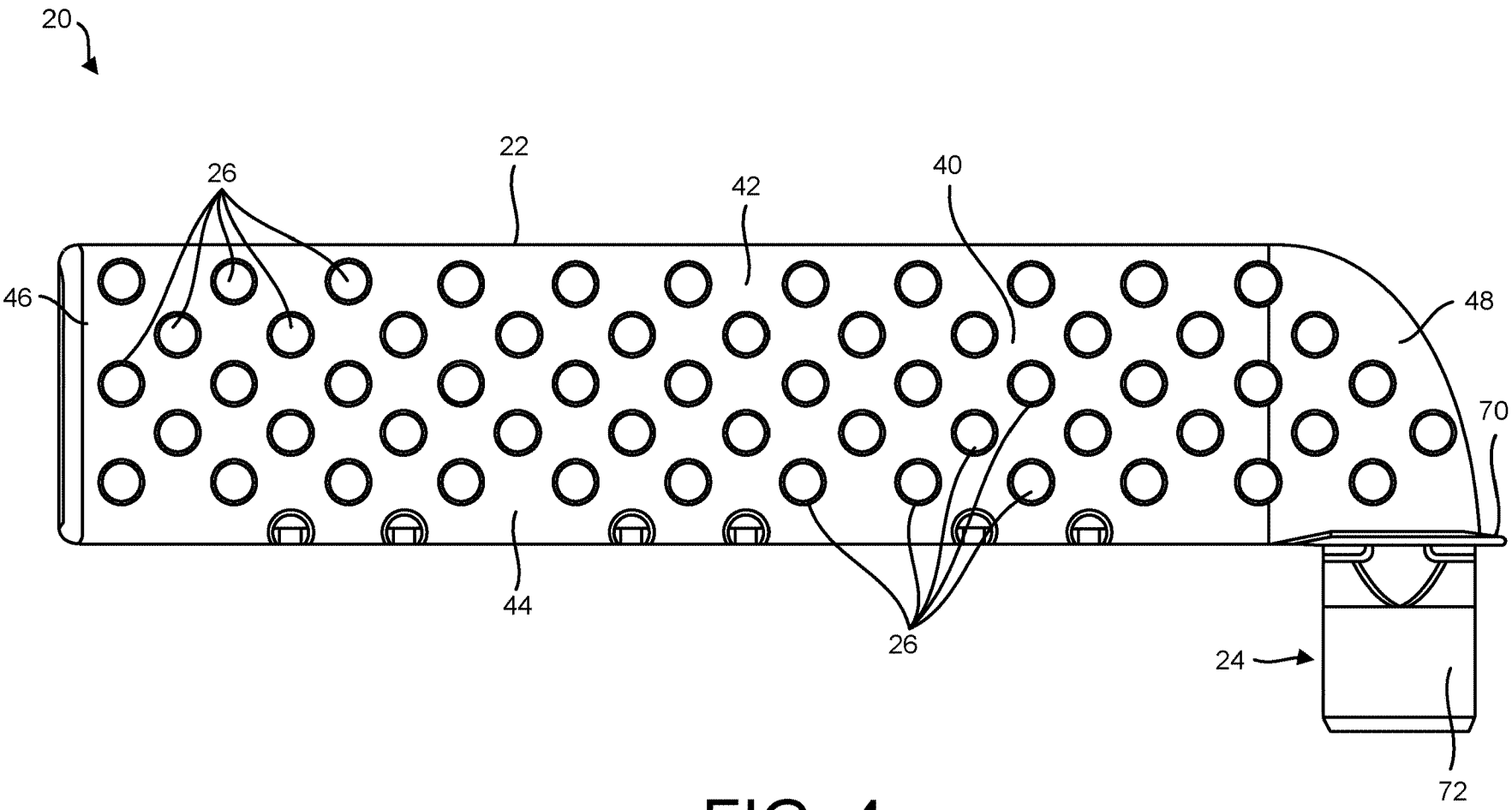
FIG. 4 illustrates a rear view of the insert of FIG. 1.
Figure 6:
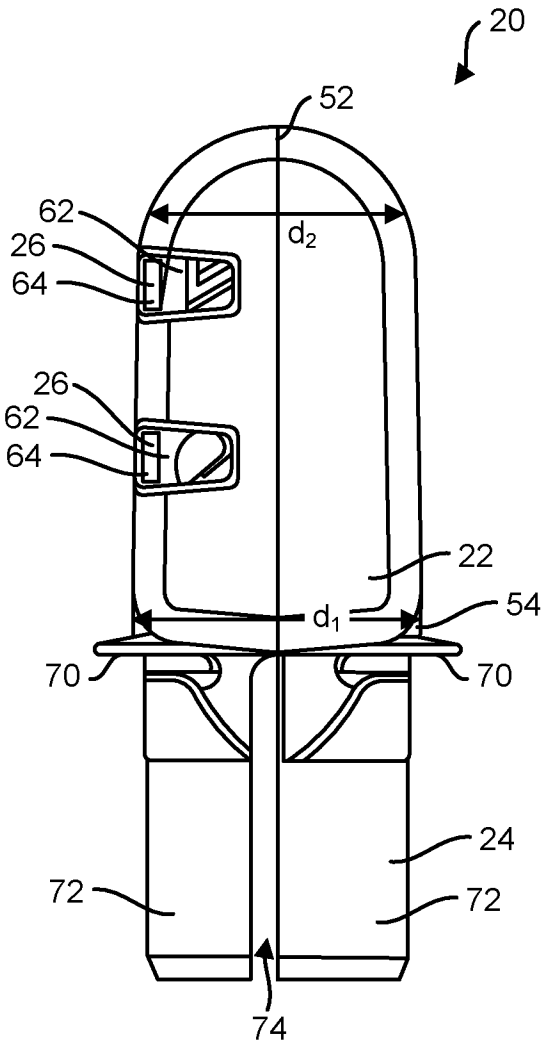
FIG. 6 illustrates a right view of the insert of FIG. 1.
Figure 5:
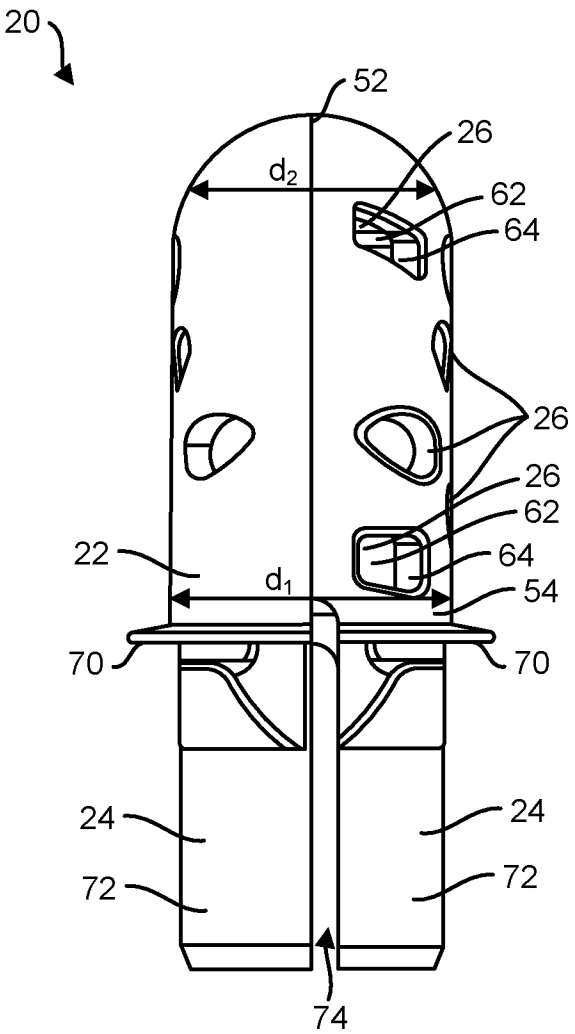
FIG. 5 illustrates a left view of the insert of FIG. 1.
Figure 7:
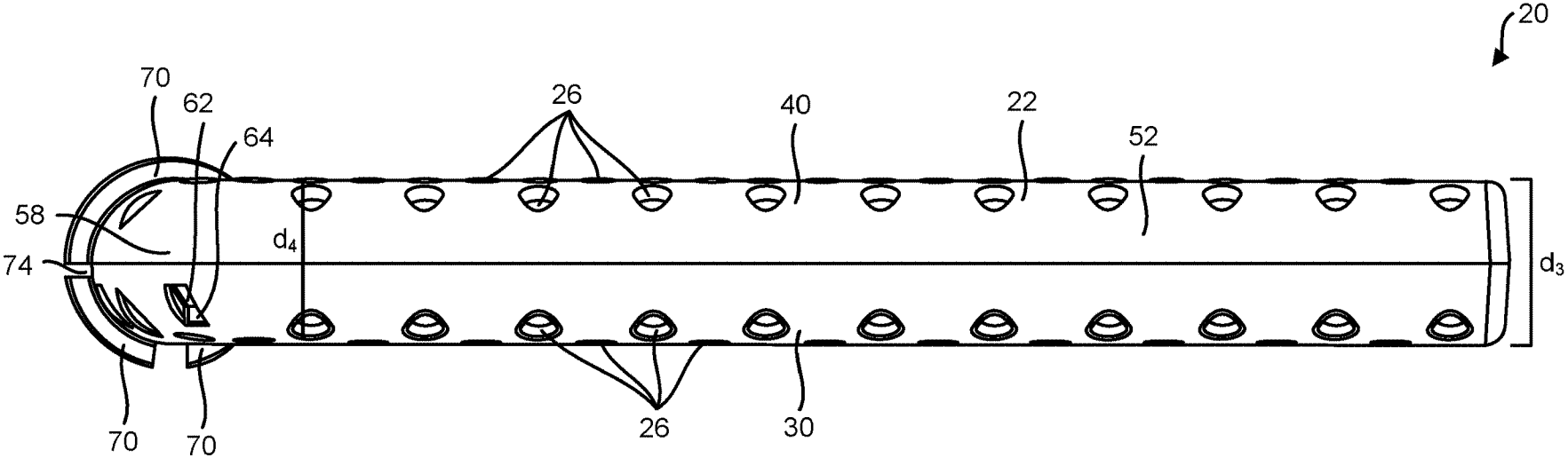
FIG. 7 illustrates a top view of the insert of FIG. 1.
Figure 8:
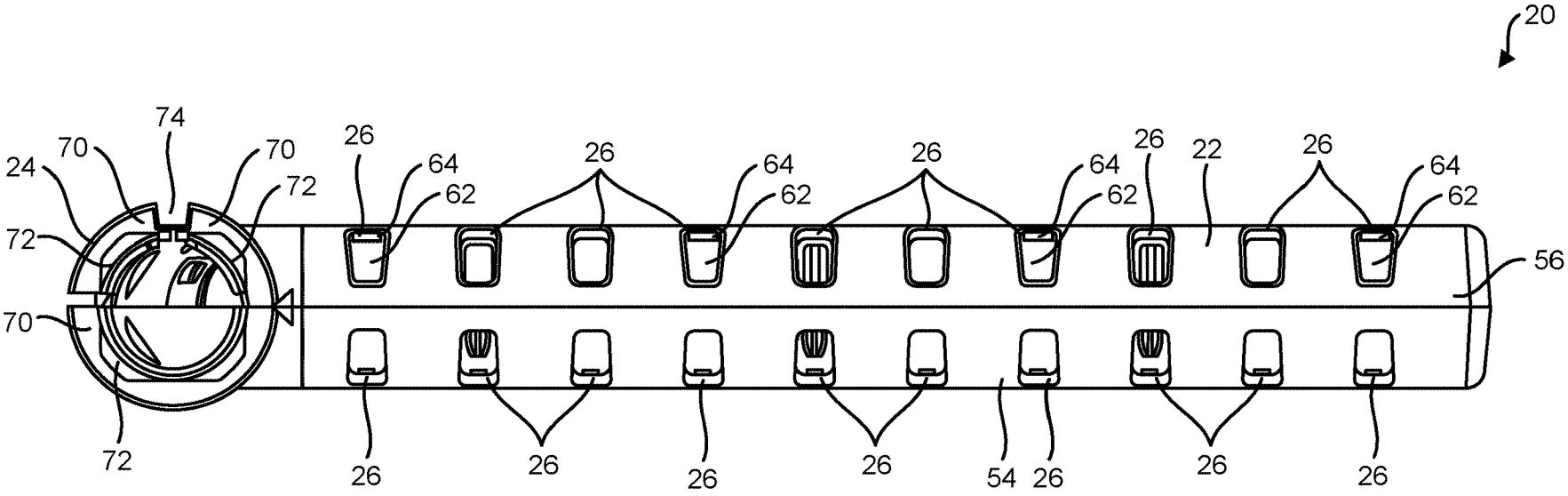
FIG. 8 illustrates a bottom view of the insert of FIG. 1.

Referring next to FIGS. 2-8, the insert 20 is further illustrated. FIG. 2 illustrates an elevated perspective view of insert 20. FIG. 3 illustrates a front view of insert 20. FIG. 4 illustrates a rear view of insert 20. FIG. 5 illustrates a left view of insert 20. FIG. 6 illustrates a right view of insert 20. FIG. 7 illustrates a top view of the insert 20. FIG. 8 illustrates a bottom view of insert 20.

As illustrated in FIG. 2, first portion 22 of insert 20 includes a plurality of apertures 26 configured to allow water to pass from gutter 100 through the apertures into an interior of insert 20 (see FIG. 9), where it can flow to downspout 114 through second portion 24. Apertures 26 are illustratively sized and positioned to restrict, reduce, and/or prevent debris such as leaves and sticks from passing through the apertures 26 into the interior of insert 20. In some embodiments, at least some apertures 26 are circular and/or oval in shape. In other embodiments, at least some apertures 26 are square, rectangular, and/or trapezoidal in shape. In still other embodiments, at least some of apertures 26 are other suitable shapes.

In some embodiments, a portion of the plurality of apertures 26 are positioned on a right side surface 30 of insert 20. One particular arrangement of apertures 26 on right side surface 30 is illustrated in FIG. 3, although any suitable arrangement may also be used. In the illustrated embodiments, apertures 26 are spaced apart across right side surface 30 from a top region 32 to a bottom region 34 and from a first end region 36 to a second end region 38.

In some embodiments a portion of the plurality of apertures 26 are positioned on a left side surface 40 of insert 20. One particular arrangement of apertures 26 on left side surface 40 is illustrated in FIG. 4, although any suitable arrangement may also be used. In the illustrated embodiments, apertures 26 are spaced apart across left side surface 40 from a top region 42 to a bottom region 44 and from a first end region 46 to a second end region 48.

Spacing of apertures 26 on and around insert 20 results in the water having many more paths to the interior of insert 20 as compared to a single hole. Water paths which are greater in number and/or distributed over a much larger area are less likely to get clogged than a single hole. While some of apertures 26 may get blocked by a leaf or other debris, the blocking of all of apertures 26 is much less likely because they are distributed over a large area and on two or more sides of insert 20. Even if there are multiple pieces of debris that block or plug a few of apertures, there are still many unobstructed paths for the water to flow. The larger the area over which they are distributed the less likely that one piece of trapped debris will lead to a complete clog or blockage.

In some embodiments, at least some of the apertures 26 positioned on the right side surface 30 have a corresponding aperture 26 positioned on the left side surface 40. In some embodiments, the pattern formed by apertures 26 positioned on the right side surface 30 substantially matches a pattern formed by corresponding apertures 26 positioned on the left side surface 40. In some embodiments, the pattern formed by apertures 26 positioned on the right side surface 30 does not match a pattern formed by corresponding apertures 26 positioned on the left side surface 40.

Referring to FIG. 3, in some embodiments, first portion 22 of insert 20 includes a badge area 92 that does not include any apertures 26. Badge area 92 may include a logo and/or product information relating to insert 20. In some embodiments, badge area 92 is positioned on right side surface 30. In some embodiments, badge area 92 is positioned on left side surface 40. In some embodiments, separate badge areas 92 are provided on both right side surface 30 and left side surface 40.

Referring to FIGS. 5 and 6, in some embodiments, top 52 of first portion 22 has a substantially rounded surface. In some exemplary embodiments, bottom 54 of first portion 22 includes one or more curved corners In some exemplary embodiments, first portion 22 has a width $d_1$ at the bottom 54 of first portion 22 that is wider than a width $d_2$ at the top 52 of first portion 22 under the rounded top 52, giving first portion a substantially trapezoidal shape. The width $d_1$ of the bottom portion 54 is larger than the width $d_2$ under the rounded top 52, such that right side surface 30 and left side surface 40 both slope inwardly from the bottom portion 54 to the top portion 52. Without wishing to be held to any particular theory, it is believed that providing a rounded surface on top 52, rounded corners on bottom 54, and/or a substantially trapezoidal cross-sectional shape to first portion 22 helps to prevent insert 20 from sealing against a side of one or more walls 106 of gutter 100, or from sealing against a leaf or other substantially flat piece of debris that is positioned between insert 20 and wall 106 of gutter 100. In this way, more apertures 26 remain available to allow water to drain out of gutter 100 through insert 20.

Referring next to FIG. 7, one or more apertures 26 may be positioned on or extend at least partially from the top 52 to first portion 22 to allow for additional draining of water out of gutter 100 through insert 20. In some embodiments, first portion 56 has an average width $d_3$ at a first end 56 that is substantially the same as an average width $d_4$ at a second end 58. In other embodiments, first portion 56 has an average width $d_3$ at a first end 56 that is less than same as an average width $d_4$ at a second end 58. In other embodiments, first portion 56 has an average width $d_3$ at a first end 56 that is greater than same as an average width $d_4$ at a second end 58.

In some embodiments, first end 56 of insert 20 is a substantially flat surface. In other embodiments, first end 56 has a curved surface. In some embodiments, first end 56 includes one or more apertures 26 for receiving water into the interior cavity of insert 20. In other embodiments, first end 56 includes no apertures 26.

In some embodiments, second end 58 of insert 20 has a curved neck connecting first portion 22 of insert 20 to second portion 24. In other embodiments, first end 56 includes no apertures 26.

Referring next to FIG. 8, one or more apertures 26 may be positioned on or extend at least partially onto the top 52 of first portion 22 to allow for additional draining of water out of gutter 100 through insert 20.

Figure 9:
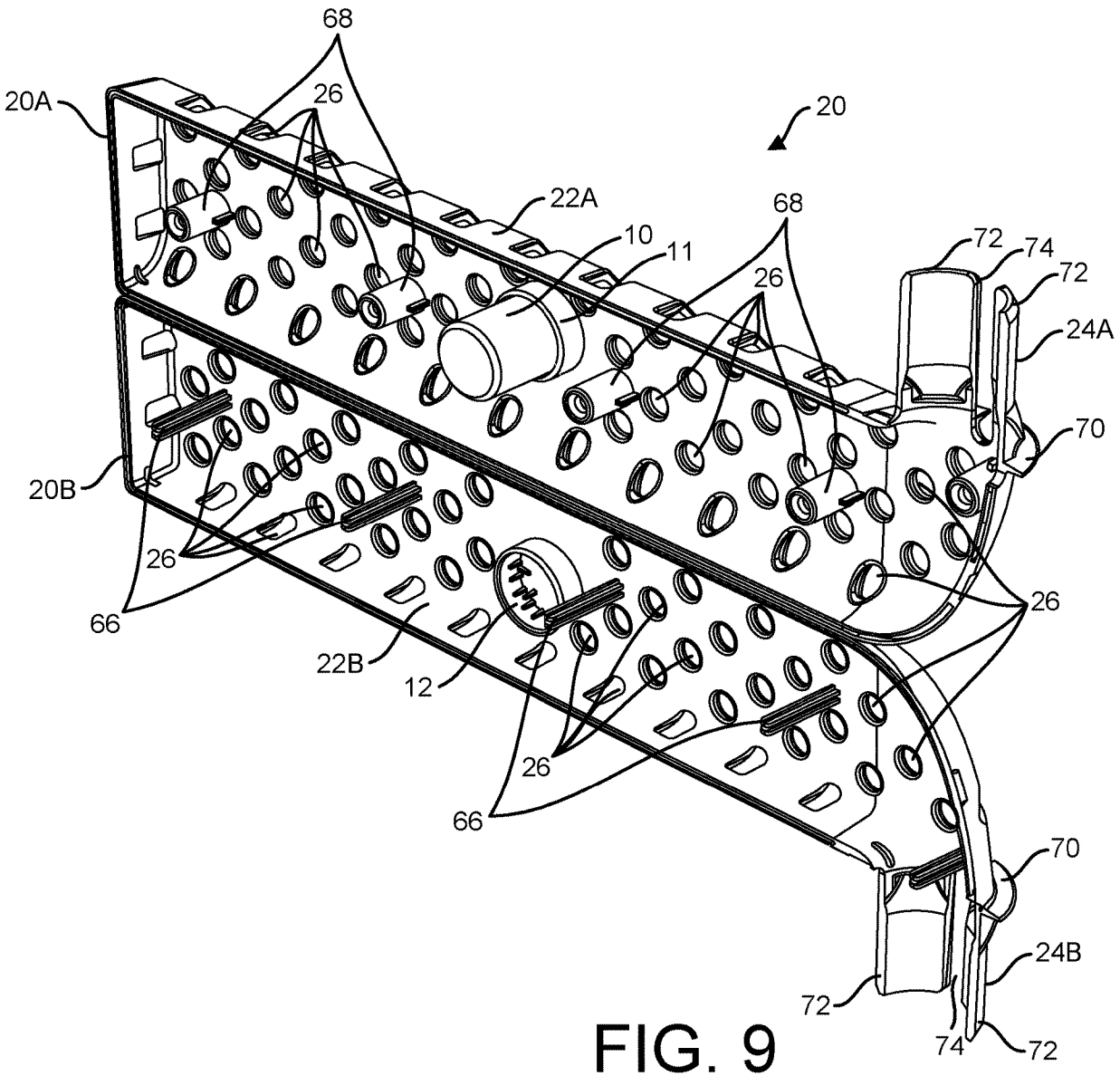
FIG. 9 illustrates an elevated perspective view of the insert of FIG. 1 in an unassembled state.

Referring next to FIG. 9, insert 20 is illustrated in an exemplary unassembled state including a first segment 20A and a second segment 20B. In some exemplary embodiments, a segment including right side surface 30 includes a portion 22A of first portion 22 and a portion 24A of second portion 24 and a segment including left side surface 40 includes another portion 22B of first portion 22 and another portion 24B of second portion 24, wherein the two portions 22A and 22B of first portion 22 and the two portions 24A and 24B of second portion 24 are configured to be coupled together when first segment 20A is coupled to second segment 20B to form insert 20. In other exemplary embodiments, first portion 22 and second portion 24 are provided as separate pieces to be coupled together to form insert 20.

In some exemplary embodiments, the segment including right side surface 30 is provided as a separate piece than the segment including left side surface 40. In other exemplary embodiments, the segment including right side surface 30 is connected to the segment including left side surface 40 via a flexible living hinge (not shown) that allows right side surface 30 to pivot about the living hinge relative to left side surface 40.

FIG. 9 also illustrates a mass 10 which may be attached to or contained in insert 20. Depending on the type, quantity, and thickness of material used to construct insert 20, as well as upon other factors, insert 20 may have a tendency to float, or partially float, as water begins to flow in the gutter. This floating may have a number of undesirable results. To counter this potential problem, one more weights or masses, such as mass 10, may be included to reduce or minimize potential floating. In the specific example of FIG. 9, mass 10 is captured and held in place by receptacle 11 and receptacle 12 when insert 20 is assembled. However, it should be understood that mass 10 may be captured by or attached to one or more portions of insert 20 in other manners.

In some examples, mass 10 may weigh more than about 0.1 pounds and less than or equal to about 0.2 pounds. In some examples, mass 10 may weigh more than about 0.2 pounds and less than or equal to about 0.3 pounds. In some examples, mass 10 may weigh more than about 0.3 pounds and less than or equal to about 0.5 pounds. In some examples, mass 10 may weigh more than about 0.5 pounds and less than or equal to about 0.7 pounds. In some examples, mass 10 may weigh more than about 0.7 pounds and less than or equal to about 1.1 pounds. In some examples, mass 10 may weigh more than about 1.1 pounds and less than or equal to about 1.5 pounds. The total weight of mass 10 may also be distributed among two or more instances of mass 10 which are attached at different locations on insert 20 and may have any shape. The weight of mass 10 may be varied depending on the length, width, height, and/or cross sectional area of insert 20.

In some embodiments, insert 20 is formed by injection molding a suitable thermoplastic material. Exemplary suitable thermoplastic materials include high-density polyethylene (HDPE), polyvinyl chloride (PVC), and polypropylene (PP).

In some embodiments, the segment including right side surface 30 is coupled to the segment including left side surface 40 with one or more snaps 62 each configured to be received within a corresponding snap receiver 64. In some exemplary embodiments, snaps 62 and/or snap receivers 64 are integrally molded into the segment including right side surface 30 and/or the segment including left side surface 40 of insert 20. In some embodiments, each snap 62 is releasably received within a corresponding snap receiver 64 to allow the insert 20 to be disassembled. In some embodiments, each snap 62 is permanently received within a corresponding snap receiver 64 such that insert 20 cannot be disassembled. As illustrated in FIGS. 5-9, in some embodiments a portion of one or more snaps 62 and/or snap receivers 64 includes an aperture 26 configured to allow water to flow into the interior cavity of assembled insert 20.

In some embodiments, the segment including right side surface 30 is coupled to the segment including left side surface 40 with one or more posts 66 each configured to be received within a corresponding post receiver 68. In some exemplary embodiments, posts 66 and/or post receivers 68 are integrally molded into the segment including right side surface 30 and/or the segment including left side surface 40 of insert 20. In some embodiments, each post 66 is releasably received within a corresponding post receiver 68 to allow the insert 20 to be disassembled. In some embodiments, each post 66 is permanently received within a corresponding post receiver 68 such that insert 20 cannot be disassembled.

Figure 10:
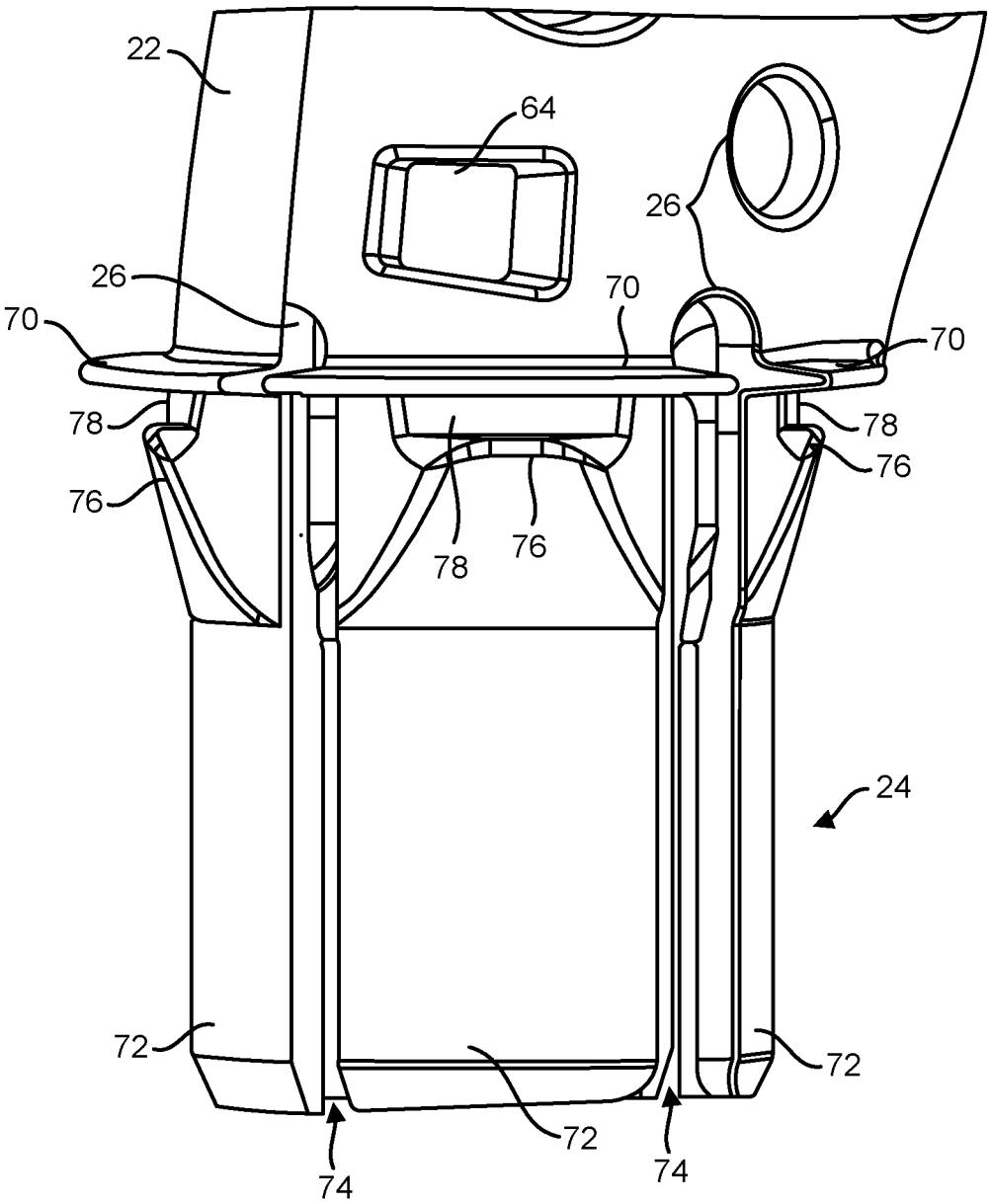
FIG. 10 illustrates an enlarged view of a portion of the insert of FIG. 1.

Referring next to FIG. 10, an enlarged view of second portion 24 is illustrated. Second portion 24 includes a flange 70. In some embodiments, flange 70 is sized to at least partially cover opening 112 to prevent debris from entering opening 112 and becoming clogged in downspout 114 (also see FIG. 1).

Second portion 24 includes one or more extensions 72 configured to extend downward from flange 70 through opening 112 into downspout 114 and/or end drop 116. In some embodiments, a plurality of extensions 72 are provided, each extension 72 being separated from a neighboring extension 72 by a slot 74 extending from a bottom of second portion 24 towards flange 70. A portion of the interior of insert 20 extends between the extensions 72, providing a path for water to flow from the interior of insert 20 into the downspout 114 and/or end drop 116.

In some embodiments, extensions 72 are formed from a resilient and/or flexible material to allow extensions 72 to be flexed inwardly to be securely positioned into downspout 114 and/or end drop 116.

In some embodiments, one or more slots 74 are positioned to allow a screw or rivet 118 connecting gutter 100 to downspout 114 to be received within slot 74 when second portion 24 of insert 20 is positioned in the downspout 114 and/or end drop 116.

In some embodiments, one or more slots 74 extend through flange 70, dividing flange 70 into two or more distinct pieces, and providing an additional path for water to flow from gutter 100 through the slot 74 in flange 70 and into the downspout 114 without going through the interior of insert 20. Slot 74 is illustratively sized to allow water to flow through slot 74 but to prevent debris such as sticks and leaves from passing through slot 74 into downspout 114. In some embodiments, one or more slots 74 connect to an aperture 26 formed in first portion 22 of insert 20.

In some embodiments, one or more extensions 72 include a snap mechanism 76 defining a gap 78 between the flange 70 and ramped snap mechanism 76. In some embodiments, a lower surface of ramped snap mechanism 76 includes a ramped surface.

Figure 11:
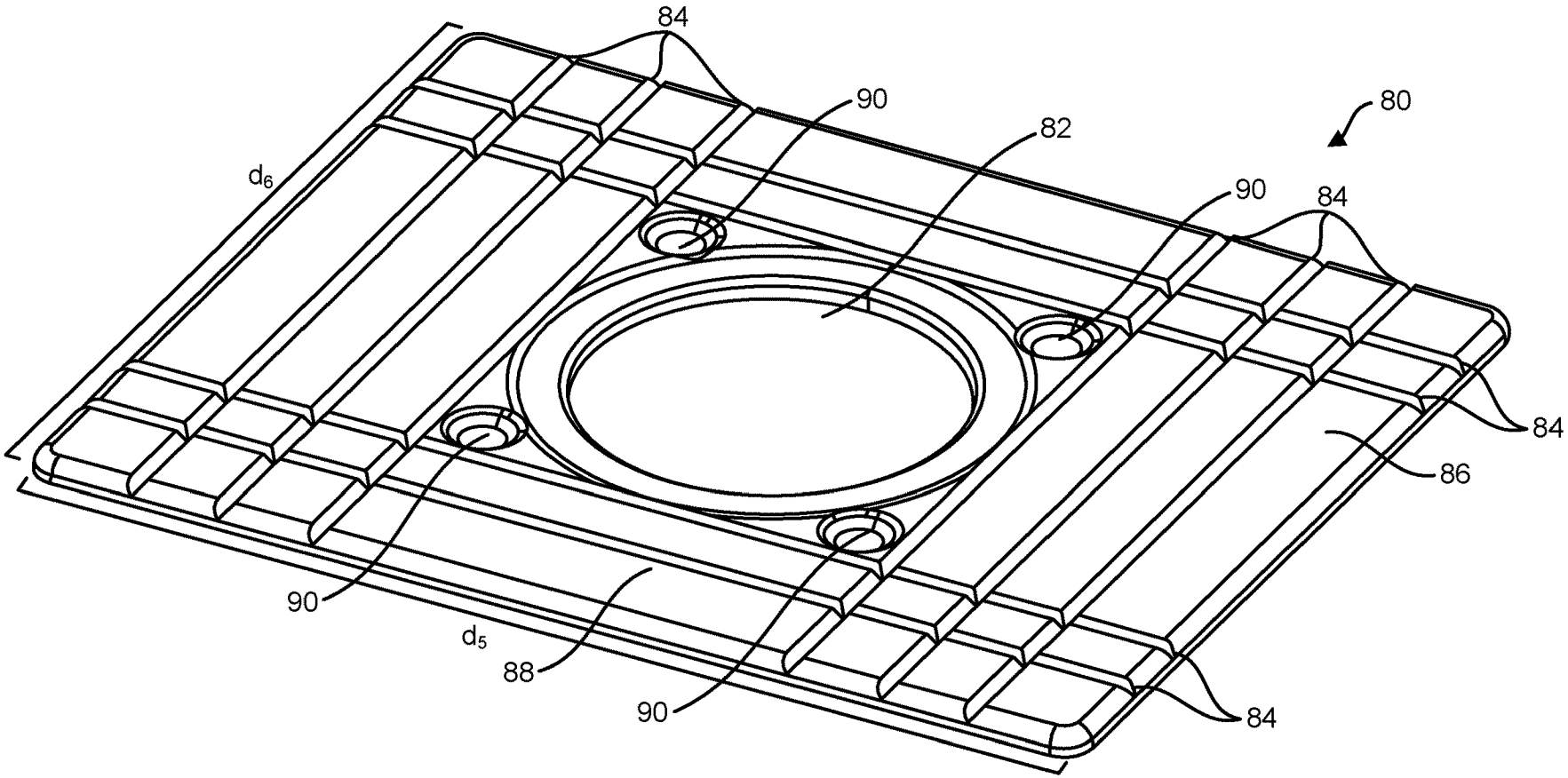
FIG. 11 illustrates an elevated perspective view of an exemplary adapter plate for use with the insert of FIG. 1.
Figure 12:
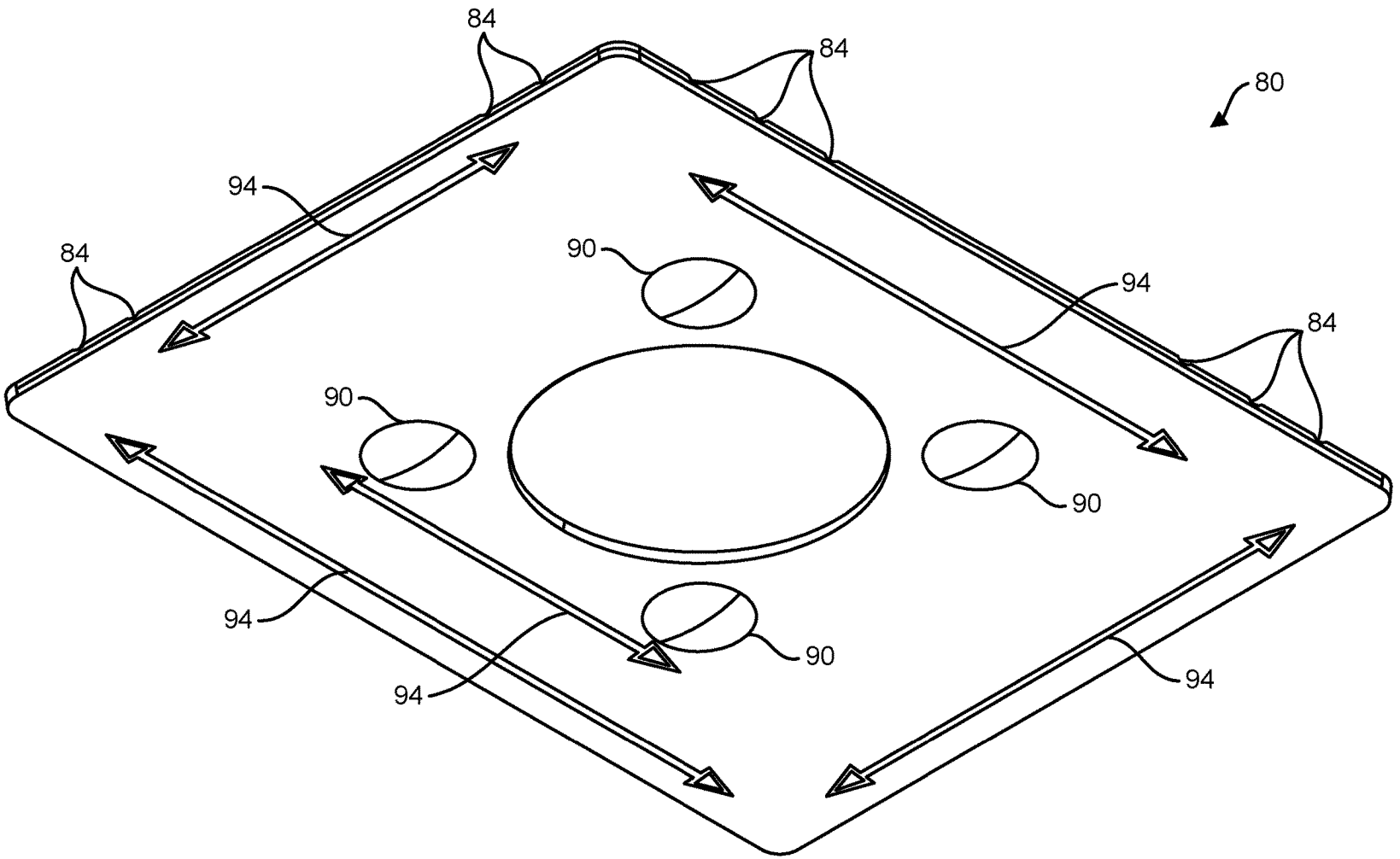
FIG. 12 illustrates a bottom perspective view of the adapter plate of FIG. 11.

Referring next to FIGS. 11 and 12, an exemplary adapter plate 80 is illustrated. In some embodiments, adapter plate 80 is configured to be received within gap 78 of second portion 24 of insert 20 (also see FIG. 13). In some embodiments, insert 20 and adapter plate 80 are provided as a set or kit to be installed in a gutter, such as gutter 100.

In some embodiments, adapter plate 80 formed by injection molding a suitable thermoplastic material. In some embodiments, insert 20 and adapter plate 80 are formed from the same material. In some embodiments, insert 20 and adapter plate 80 are formed from different materials. Exemplary suitable thermoplastic materials include high-density polyethylene (HDPE), polyvinyl chloride (PVC), and polypropylene (PP).

As illustrated in FIG. 11, adapter plate 80 has a first length $d_5$ and a second length $d_6$. In some embodiments, $d_5$ is greater than $d_6$. In other embodiments, $d_5$ is the same as $d_6$.

Figure 13:
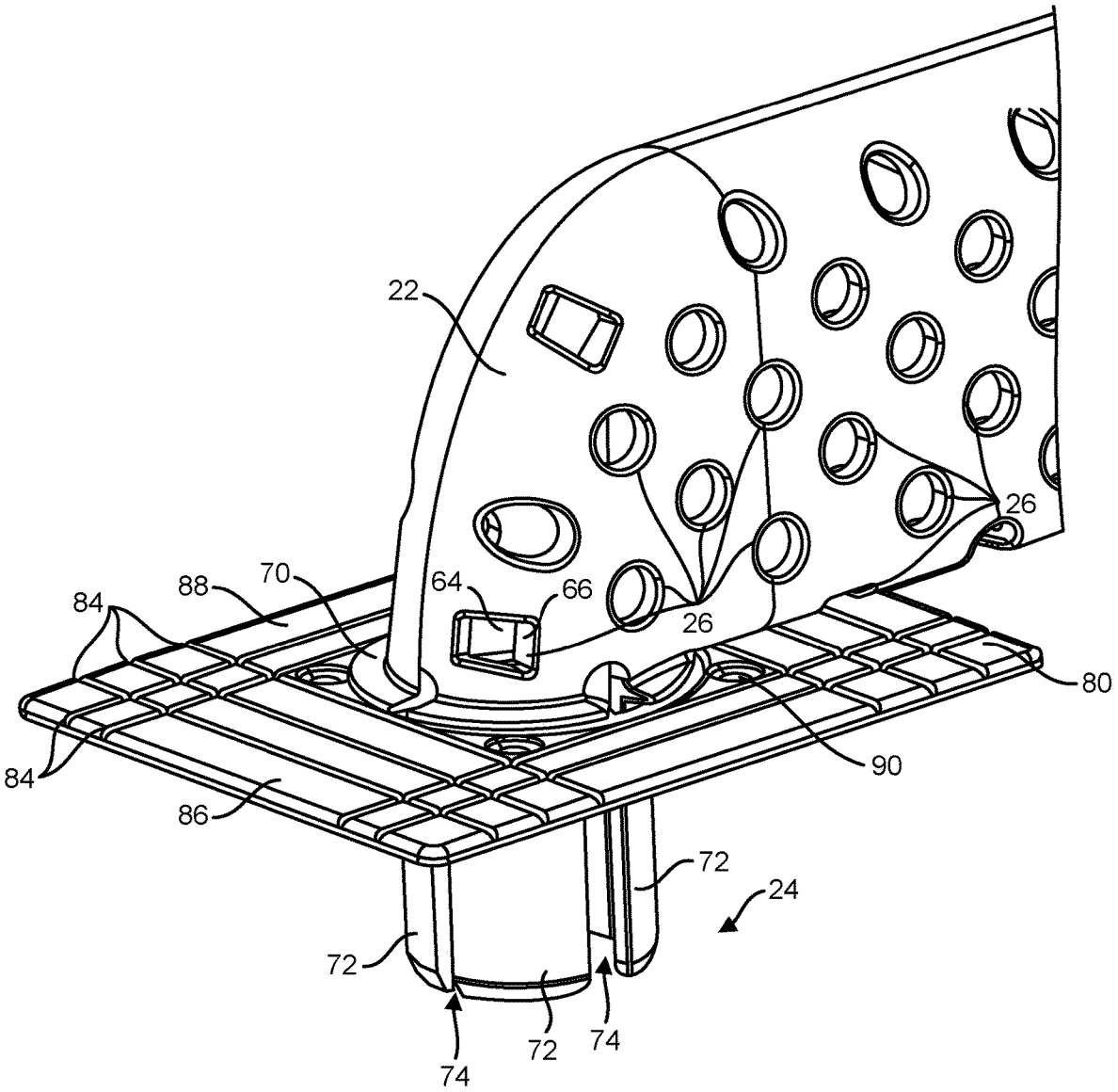
FIG. 13 illustrates the adaptor plate of FIG. 11 affixed to the insert of FIG. 1.

Adapter plate 80 includes an aperture 82 extending through adapter plate 80. As illustrated in FIG. 13, the extensions 72 of second portion 24 of insert 20 are configured to be positioned through aperture 82 of adapter plate 80. In some embodiments, the sides of aperture 82 contact a ramped lower surface of snap mechanism 76. The presence of gaps 78 allow extensions 72 to flex inwardly and adapter plate 80 to pass past snap mechanism 76 into gap 78. Once adapter plate 80 is positioned in gap 78, extensions 72 resiliently flex back outwardly, semi-permanently securing adapter plate 80 to insert 20. In some examples, the components may be designed such that insert 20 may be removed from adapter plate 80 for cleaning, maintenance, and/or replacement.

In some exemplary embodiments, the diameter of aperture 82 is larger than the diameter of second portion 24 in gap 78, and the thickness of aperture 82 is larger than the height of gap 78. This allows adapter plate 80 to rotate about second portion 24 of insert 20 when secured in gap 78. By being able to rotate, a user can position adapter plate 80 within gutter 100 in an advantageous orientation. In one example, the adapter plate 80 can be rotated such that a longer length $d_5$ of adapter plate 80 is positioned parallel with a longitudinal axis of gutter 100. In another example, the adapter plate 80 can be rotated such that a shorter length $d_6$ of adapter plate 80 is positioned parallel with a longitudinal axis of gutter 100.

Referring again to FIG. 11, in some embodiments, adapter plate 80 includes one or more scoring lines 84 or small channels on a surface of adapter plate 80. In the illustrated embodiment, the scoring lines 84 are positioned on a top surface of adapter plate 80. In another embodiment, the scoring lines 84 are positioned on a bottom surface of adapter plate 80. In still another embodiment, the scoring lines 84 are positioned on both a top surface and a bottom surface of the adapter plate 80.

In the illustrated embodiment, adapter plate 80 includes a first plurality of scoring lines 84 extending in a first direction and a second plurality of scoring lines 84 extending in a second direction perpendicular to the first direction. The first and second plurality of scoring lines 84 intersect to form a grid-like pattern on one or more surfaces of adapter plate 80.

In one embodiment, the adapter plate 80 is formed from a flexible or resilient material. To fit into a gutter 100 having a width less than $d_6$, a first portion 86 of the adapter plate 80 can be folded about the scoring line 84 to allow the adapter plate 80 to fit into the gutter 100. To fit into a gutter 100 having a width less than $d_5$, a second portion 88 of the adapter plate 80 can be folded about the scoring line 84 to allow the adapter plate 80 to fit into the gutter 100.

In one embodiment, the scoring lines 84 are configured to allow a user to cut or break adapter plate 80 along the scoring line 84. To fit into a gutter 100 having a width less than $d_6$, a first portion 86 of the adapter plate 80 can be cut or broken off along the scoring line 84 to allow the adapter plate 80 to fit into the gutter 100. To fit into a gutter 100 having a width less than $d_5$, a second portion 88 of the adapter plate 80 can be cut or broken off along the scoring line 84 to allow the adapter plate 80 to fit into the gutter 100.

In some embodiments, the scoring lines 84 are regularly spaced apart. In other embodiments, the scoring lines 84 are positioned to provide different lengths of portions 86, 88 to be folded, cut, or broken. In some examples, the locations of scoring lines 84 may correspond to various standard, or semi-standard, sizes of gutters or gutter systems.

Referring next to FIG. 12, a bottom surface of adapter plate 80 includes one or more stand-offs 90. The stand-offs 90 are configured to prevent the bottom surface of adapter plate 80 from being flush with the bottom 106 of gutter 100. Stand-offs allow for better water drainage below adapter plate 80, and prevent adapter plate 80 from sealing to bottom 106 of gutter 100.

In some embodiments, the bottom surface of adapter plate 80 further includes one or more indicia 94. The indicia 94 may indicate the distance between various scoring lines 84 on the same or opposite surface of adapter plate 80.

The elements, components, and steps described herein are meant to exemplify some types of possibilities. In no way should the aforementioned examples limit the scope of the invention, as they are only exemplary embodiments.

The phrases "in some embodiments," "according to some embodiments," "in the embodiments shown," "in other embodiments," "in some examples," "in other examples," "in some cases," "in some situations," "in one configuration, " "in another configuration," and the like generally mean that the particular technique, feature, structure, or characteristic following the phrase is included in at least one embodiment of the present invention and/or may be included in more than one embodiment of the present invention. In addition, such phrases do not necessarily refer to the same embodiments or to different embodiments.

The foregoing disclosure has been presented for purposes of illustration and description. Other modifications and variations of the disclosed techniques may be possible in view of the above teachings. The embodiments described in the foregoing disclosure were chosen to explain the principles of the concept and its practical application to enable others skilled in the art to best utilize the invention. It is intended that the claims be construed to include other alternative embodiments of the invention, except as limited by the prior art.

What is claimed is:

1. An insert for use with a rain gutter attached to a downspout, the insert comprising:

a first portion configured to be positioned in the rain gutter, the first portion comprising a plurality of apertures distributed around a surface of the first portion, the apertures extending between an exterior of the first portion and an interior of the first portion, the apertures configured to allow water to flow from the rain gutter into an interior of the first portion when the insert is positioned in the rain gutter;

a second portion extending downward from the first portion and configured to be positioned in an opening of the rain gutter connected to the downspout, the second portion including a plurality of extensions separated by one or more slots, the plurality of extensions configured to be positioned in the opening connected to the downspout, the second portion further including a flange configured to be positioned above the opening of the rain gutter, the second portion including an interior in fluid communication with the interior of the first portion, the interior of the second portion configured to allow the water to flow from the interior of the first portion through the interior of the second portion and into the downspout; and an adapter plate having an aperture extending therethrough, the plurality of extensions of the second portion of the insert configured to be positioned through the aperture of the adapter plate.

2. The insert of claim 1, wherein the first portion includes a weight to prevent the insert from floating.

3. The insert of claim 1, wherein a first end of the first portion has a cross sectional area that is smaller than a cross sectional area of a second end of the first portion.

4. The insert of claim 1, wherein the flange is configured to cover the opening of the rain gutter, the flange including at least one aperture configured to allow water to flow from the rain gutter through the flange and into the downspout, and wherein the at least one aperture in the flange extends from an aperture in the first portion to a slot of the one or more slots.

5. The insert of claim 1, wherein one slot of the one or more slots is positioned to receive a screw or rivet affixing the rain gutter to the downspout.

6. The insert of claim 1, wherein a top surface of the adapter plate includes a plurality of scoring lines extending into the top surface of the adapter plate.

7. The insert of claim 1, wherein a bottom surface of the adapter plate includes one or more standoffs.

8. The insert of claim 1, wherein the a cross section of the first portion has a trapezoidal shape including a substantially flat bottom side and side walls which taper to a top side that is shorter than the bottom side.

9. The insert of claim 8 wherein the top side of the cross section of the first portion is rounded.

10. The insert of claim 1, wherein one or more extensions of the second portion includes a gap defined between the flange and a snap mechanism of the second portion, the adapter plate configured to be received within the gap and the adapter plate is configured to rotate within the gap.

11. The insert of claim 10, wherein a bottom surface of the snap mechanism includes a ramped surface.

12. The insert of claim 1, wherein the first portion comprises a first segment comprising a right side surface of the first portion and a second segment comprising a left side surface of the first portion, the right side surface comprising a first number of apertures of the plurality of apertures and the left side surface comprising a second number of apertures of the plurality of apertures.

13. The insert of claim 12, wherein an interior surface of one of the first segment and the second segment includes one or more rods each configured to be received in a corresponding rod receiver positioned on an interior surface of the other of the first segment and the second segment.

14. The insert of claim 13, wherein the first segment is configured to be permanently affixed to the second segment when each of the one or more rods is received in the corresponding receiver.

15. The insert of claim 12, wherein one of the first segment and the second segment includes a snap configured to be received in a corresponding snap receiver positioned on the other of the first segment and the second segment.

16. The insert of claim 15, wherein at least one of the snap and the snap receiver includes an aperture configured to allow water to flow from the rain gutter into an interior of the first portion.

17. A kit for use with a gutter and a downspout, the kit comprising:

an insert comprising:

a first portion configured to be positioned in the gutter, the first portion comprising a plurality of apertures distributed around a surface of the first portion and configured to allow water to flow from the gutter into an interior of the first portion through the plurality of apertures;

a mass attached to the first portion for increasing the weight of the first portion;

a second portion extending downwardly from the first portion and configured to be positioned in an opening of the gutter connected to the downspout, the second portion including a plurality of extensions separated by one or more slots, the plurality of extensions configured to positioned in the opening and a flange configured to be positioned above the opening, the second portion including an interior in fluid communication with the interior of the first portion, the interior of the second portion configured to allow water to flow from the interior of the first portion through the interior of the second portion and into the downspout; and an adapter plate having an aperture therethrough, the plurality of extensions of the second portion of the insert configured to be positioned through the aperture.

18. A method of protecting a downspout from being clogged with debris, the method comprising:

positioning a first portion of an insert having a plurality of apertures into a gutter attached to the downspout and a second portion of an insert into an opening connecting the gutter down the downspout, the second portion extending downward from the first portion and including a plurality of extensions separated by one or more slots and a flange, the plurality of extensions configured to positioned into the opening and the flange configured to be positioned above the opening, the insert including an interior configured to allow water to flow through one or more the plurality of apertures into the interior of the first portion and through the interior of the insert into the downspout; and attaching an adapter plate to the insert by positioning the plurality of extensions of the second portion of the insert through an aperture in the adapter plate, the attached adapter plate adapted to rotate about the plurality of extensions.

* * * * *